United States Patent [19]

Hathorn

[11] Patent Number: 4,890,585

[45] Date of Patent: Jan. 2, 1990

[54] INTERNAL COMBUSTION ENGINE WITH VALVE

[75] Inventor: William Hathorn, Brooksville, Fla.

[73] Assignee: General Electric Company, Cincinnati, Ohio

[21] Appl. No.: 276,998

[22] Filed: Nov. 28, 1988

[51] Int. Cl.[4] ..... F02B 75/04

[52] U.S. Cl. ..... 123/48 A; 123/78 D

[58] Field of Search ..... 123/48 R, 48 A, 48 AA, 123/48 D, 78 D, 65 V

[56] References Cited

U.S. PATENT DOCUMENTS

| | | | |
|---|---|---|---|
| 1,722,799 | 7/1929 | Jones et al. | 123/90.14 |
| 3,741,175 | 6/1973 | Rouger | 123/48 R |
| 3,842,812 | 10/1974 | Marcus | 123/90.14 |
| 4,286,552 | 9/1981 | Tsutsumi | 123/48 B |
| 4,516,537 | 5/1985 | Nakahara et al. | 123/48 AA |
| 4,619,236 | 10/1986 | Okada et al. | 123/48 A |

FOREIGN PATENT DOCUMENTS

| | | | |
|---|---|---|---|
| 0031820 | 3/1979 | Japan | 123/48 AA |
| 0114625 | 6/1979 | Japan | 123/48 D |
| 2000551 | 1/1979 | United Kingdom | 123/48 AA |

*Primary Examiner*—David A. Okonsky

*Attorney, Agent, or Firm*—Jerome C. Squillaro; Nathan D. Herkamp

[57] ABSTRACT

A conventional internal combustion engine having at least one combustion chamber, the combination of a first means for varying the volume of said combustion chamber, an intake valve operated solely by vacuum forces occurring within said combustion chamber, and a second means for varying the volume of said combustion chamber, said second means for varying the volume of said combination chamber being selectively movable in response to pressure conditions within said combustion chamber.

5 Claims, 2 Drawing Sheets

INTERNAL COMBUSTION ENGINE WITH VALVE

BACKGROUND OF THE INVENTION

1. Field of the Invention

This invention relates generally to four stroke internal combustion engines and particularly to a means for varying the volume of a combustion chamber in combination with a spring loaded intake valve in a fuel injected internal combustion engine.

2. Prior Art

One of the main objectives toward operating an optimally functioning internal combustion engine is to maintain a constant combustion chamber pressure throughout all operating ranges. This result is typically achieved by varying the volume of the combustion chamber during the operating cycle of the engine. When the engine is running in the lower RPM range, it is desirable to utilize higher compression ratios in order to obtain more power to overcome the static friction forces of the engine. At higher RPM, the compression ratio may be reduced by increasing the volume of the combustion chamber at such a rate as to keep the combustion chamber pressure constant or near constant. That is, as the speed of the engine is increased, a larger quantity of fuel and air is introduced into the combustion chamber. This increased volume of intake charge gives rise to an increased pressure in the combustion chamber. Increasing the volume of the combustion chamber in like proportion allows the pressure therein to remain relatively constant.

However, when the volume of the combustion chamber is made too small (i.e. at low engine speed), the retarding forces acting on the downwardly traveling piston on the power stroke results in a substantial power loss as the piston approaches bottom dead center (BDC).

Of the prior art devices which disclose varying the combustion chamber volume for the purpose of increasing the operating efficiency thereof, none provide a means for decreasing the retarding (vacuum) forces acting on the downwardly traveling piston on the power stroke. Representative efforts at providing variable volume combustion chambers are disclosed in the following U.S. Pat. Nos.:

| | |
|---|---|
| 4,625,684 | 4,539,946 |
| 4,516,537 | 4,449,489 |
| 4,313,403 | 4,286,552 |
| 4,187,808 | 3,970,056 |

It is a primary object of the instant invention to provide an internal combustion engine wherein the compression ratio is varied by means of a reciprocally moving piston used in conjunction with a spring loaded intake have instead of the ordinary poppet valve.

Another object of the present invention is to provide a combustion chamber in an internal combustion engine capable of maintaining a relatively constant combustion chamber pressure throughout all operating RPM ranges.

It is a still further object of the present invention to provide a combustion chamber for an internal combustion engine capable of operating, while at idle, at an unusually high compression ratio, while at the same time providing for the reduction of substantially all of the retarding forces caused by negative pressure on the downwardly traveling piston during the intake and power strokes.

These and other objects will be apparent hereinafter.

SUMMARY OF THE INVENTION

With all internal combustion engines and particularly automotive engines, full power is only required during a small percentage of the operating time. With a fixed volume combustion chamber, peak power, thus optimal efficiency, can be attained under only limited circumstances. In order to maximize the output of the internal combustion engine over a wide range of operating conditions, it is necessary to vary the volume of the combustion chamber in such a way that the pressure within the combustion chamber is maintained relatively constant throughout most if not all RPM ranges. For example, at low RPM operation (e.g.: idle) a relatively high compression ratio is all that is required to obtain optimal or near optimal energy output. In the typical internal combustion engine in use today, such a compression ratio might be on the order of 200:1 or higher. Under such conditions, a significant amount of retarding (vacuum) force would be exerted on the downwardly traveling piston after combustion (power stroke) thereby diminishing the effect of the combustion on the piston and crank shaft.

To overcome this disadvantage, the instant invention proposes to incorporate in association with the typical internal combustion engine both a variable volume chamber for varying the volume of the combustion chamber itself, and an intake valve which is operated by combustion chamber and intake manifold pressure forces instead of the ordinary cam lobe or rocker arm contact force.

The operation of the modified internal combustion engines is as follows: during starting of the internal combustion engine, the auxiliary piston would be drawn into the up position thereby enlarging the combustion chamber to its maximum or near maximum volume. A larger combustion chamber volume (hence lower compression ratio) facilitates the starting of the engine. Once the engine is started, suitable electro/mechanical control means are employed to maintain a generally constant internal combustion chamber pressure. Therefore, and for example, at low RPM, a pressure transducer means may indicate to a reversible motor that the auxiliary piston should be in the lowered or high compression ratio position. Thereafter, upon increased engine speed, the higher pressure existing in the combustion chamber gives rise to a higher pressure reading at the pressure transducer thereby signaling to the means for raising the auxiliary piston (i.e. reversible motor) that the compression ratio must be decreased (i.e. that the auxiliary piston must be raised up away from the standard piston).

Means may be employed for relating the fuel injector supply line with the auxiliary piston/reversible motor arrangement wherein the fuel pressure in said supply line is reduced proportionately to a decrease in combustion chamber volume brought about by lowering of the auxiliary piston. The need for such a relationship would generally arise from the decreased amount of fuel required in a combustion chamber of smaller volume. For example, but not by way of limitation, a bypass line may be shunted into the fuel injector supply line to divert a portion of the fuel therein to a reservoir or back to the automobile's fuel tank.

BRIEF DESCRIPTION OF THE DRAWINGS

The invention will now be explained in more detail with the aid of the examples shown in the accompanying drawings.

DETAILED DESCRIPTION OF THE PREFERRED EMBODIMENT

Figure 1A:
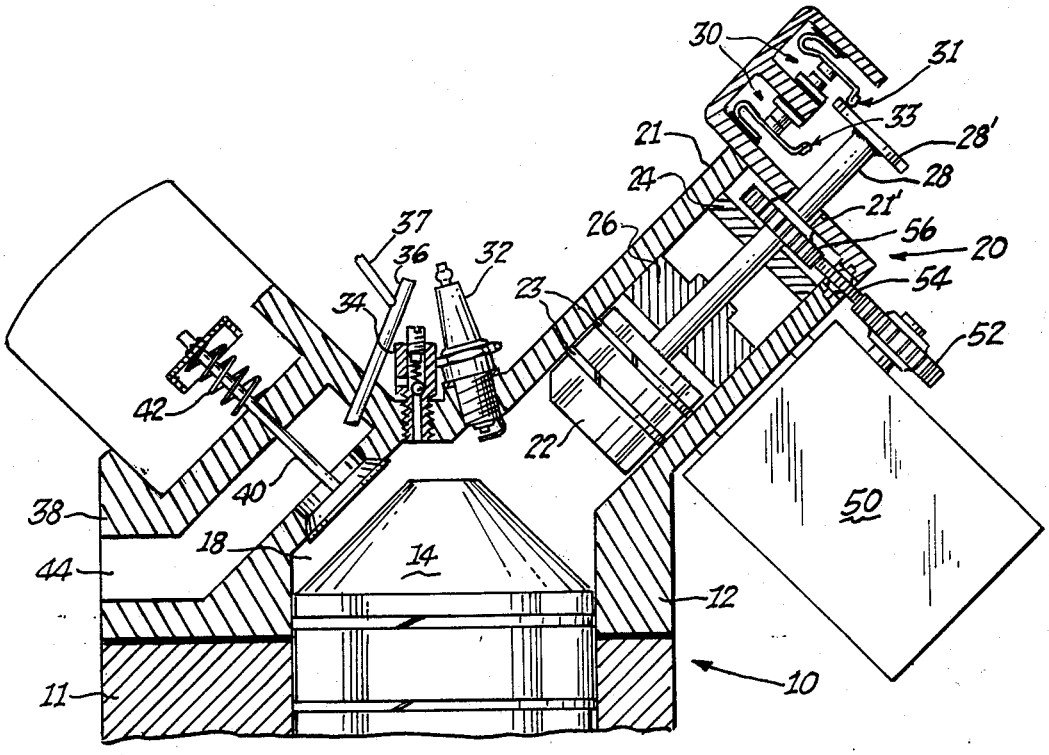
FIG. 1A shows a sectional view of an internal combustion engine showing the combustion chamber volume varying means and a spring loaded intake valve.

Referring now to the drawings, FIG. 1A shows a sectional view of a portion of an internal combustion engine 10 having associated therewith a variable volume auxiliary combustion chamber 20 which can be used to adjust the aggregate volume of conventional combustion chamber 18. Also used in connection with said conventional combustion chamber 18 is intake valve 40, which is surrounded by valve spring 42 and which is movable between a closed and open position depending upon the magnitude of pressure forces within combustion chamber 18 and intake manifold plenum 44. Intake valve 40 is biased into a normally closed position using compression spring 42 in a manner to be fully described below.

It is to be understood throughout the disclosure that the auxiliary combustion chamber arrangement 20 and spring-loaded intake valve 40 can be used on any fuel injected, four stroke internal combustion engine regardless of the number of cylinders involved. The instant disclosure will utilize a single piston/cylinder/combustion chamber arrangement for purposes of illustration only. It is to be understood, however, that the scope of the disclosure herein is not intended to be limited to single piston type arrangements.

Referring now specifically to FIG. 1, there is shown an internal combustion engine 10 having engine block 11 integrally connected with the cylinder head 12. Reciprocal piston 14 arranged on connecting rod wristpin 16 is movable from an upper, top dead center (TDC) position to a lowered, bottom dead center (BDC) position as typically found in most internal combustion piston engines. Arranged in juxtaposition to the top surface of piston 14 are a spark plug 32, a combustion pressure tap 34 to be described more fully hereinafter and a fuel injection nozzle 36 which discharges the desired quantity of fuel into a stream of intake air, preferably at a point upstream of intake valve 40. For purposes of definition, the upstream side of intake valve 40 is the side closest to intake valve spring 42 and the downstream side thereof faces the top of piston 14.

As a means for varying the combustion chamber volume, and hence the compression ratio of the engine, a variable volume auxiliary combustion chamber arrangement 20 may be integrally incorporated with cylinder head 12 in any suitable manner. Said variable volume auxiliary combustion chamber arrangement 20 is preferably comprised of a housing 21, an auxiliary piston 25 with conventional sealing rings 23 disposed about the periphery of said auxiliary piston, threaded shaft 28 which is disposed through apertures in the upper end of housing 21, support bridge member 24 and sealed shaft guide 26. The upper end of shaft 28 has associated therewith a contact end 28' which is disposed in registry with movable contact points 30.

Figure 1B:
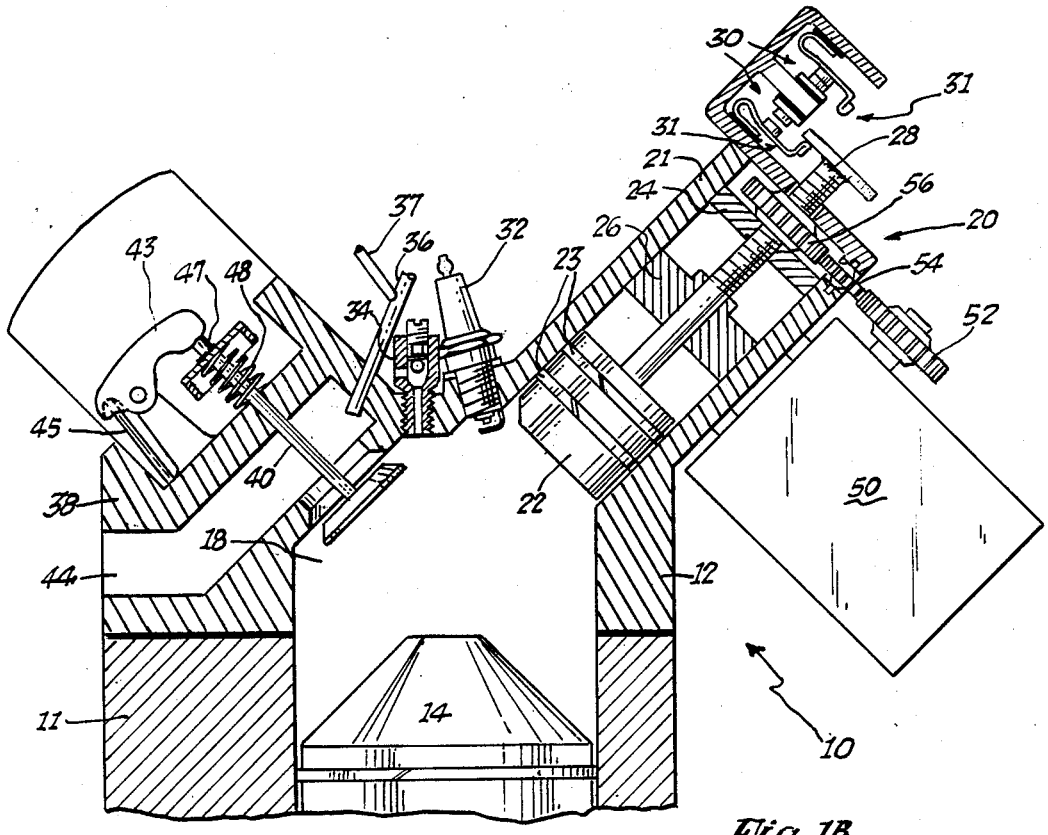
FIG. 1B shows a sectional view of an internal combustion engine showing the combustion chamber volume varying means and an exhaust valve/rocker arm arrangement.

As best seen in FIGS. 1A and 1B, contact points 30 are normally closed. In this state the circuit to energize the reversible DC motor is maintained closed. As sub or auxiliary piston 22 is brought to either its fully raised (FIG. 1A) or fully lowered (FIG. 1B) position, end 28, contacts either finger 31 or finger 33, respectively, thereby opening points 30 and deenergizing reversible DC motor 50. The next time motor 50 is energized, its output shaft and sprocket 52 will rotate opposite to its last prior direction to thereby cause piston 22 to move opposite its last prior direction. Fingers 31 and 33 are preferable made of resilient material having substantial resistance fatigue from flexure. Also associated with shaft 28 is a sprocket 56 which has an internal through opening threaded for mating engagement with the threads on shaft 28. Sprocket 56 is held in rotatable alignment in coaxial relationship with shaft 28 by member 24 and upper end of auxiliary piston housing 21', Bearings (not shown) may be provided to assist in the free rotation of sprocket 56.

Means for transferring rotational movement from sprocket 56 to a reversible motor means 50 is comprised, in the preferred embodiment, of an intermediate free-spinning gear 54 which is operably engaged by gear 52. Gear 52 is connected to an output shaft of said motor means 50. Motor means 50 is preferably fixed relative to said auxiliary piston housing 21.

Sprocket 56 has internal threads which engage corresponding threads on threaded shaft 28 whereby when reversible motor gear 52 is set in motion by said motor means 50, gear 54 is caused to rotate due to its operable connection to gear 52. Gear 54 in turn causes gear 56 to rotate thereby leading to the reciprocal linear movement of shaft 28 and auxiliary piston 22 along the axis of rotation of gear 56.

Therefore, said auxiliary combustion chamber arrangement 20 may be cast with cylinder head 12 as one unit or may be retrofit by welding or other suitable means of attachment or may simply be connected using conventional fastening means such as bolts.

Generally, means are provided in association with combustion chamber 18 whereby the ambient pressure therein is controlled. Should that pressure be less than the desired optimal combustion chamber pressure, auxiliary piston 22 will be caused to move downwardly, or toward the top of piston 14 to thereby reduce the volume within the aggregate combustion chamber until the optimal pressure therein is reached, at which time the auxiliary piston will be caused by appropriate electro/-mechanical controls to stop movement. Conversely, should the ambient pressure within aggregate combustion chamber 18 become too high, as at elevated RPM, auxiliary piston 22 may be made to move upwardly and away from piston 14, thereby decreasing the aggregate ambient pressure within aggregate combustion chamber 18.

Figure 2A:
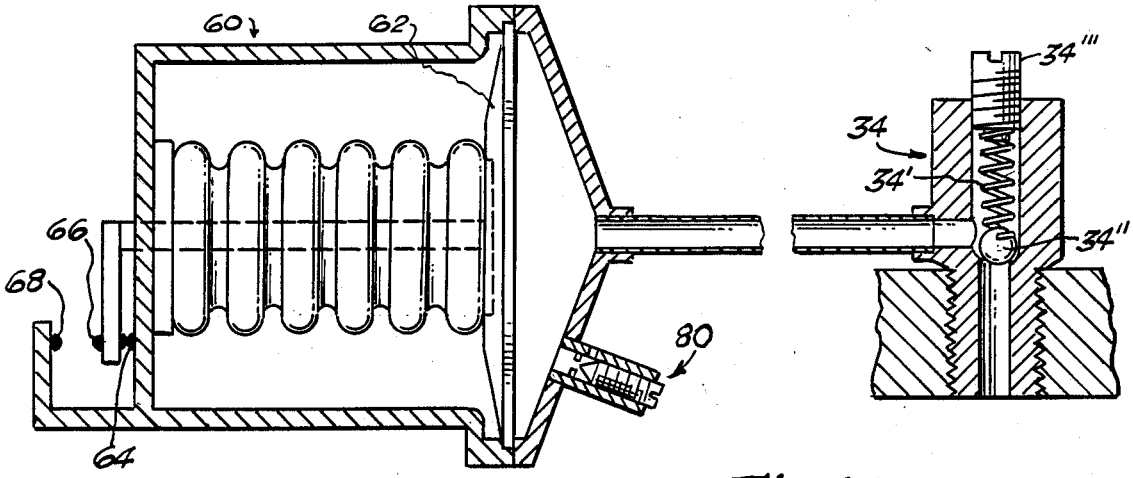
FIG. 2A shows a cross-section view taken along line 2—2 of FIG. 1A of one embodiment of a pressure transducer means in the normally closed position.
Figure 2B:
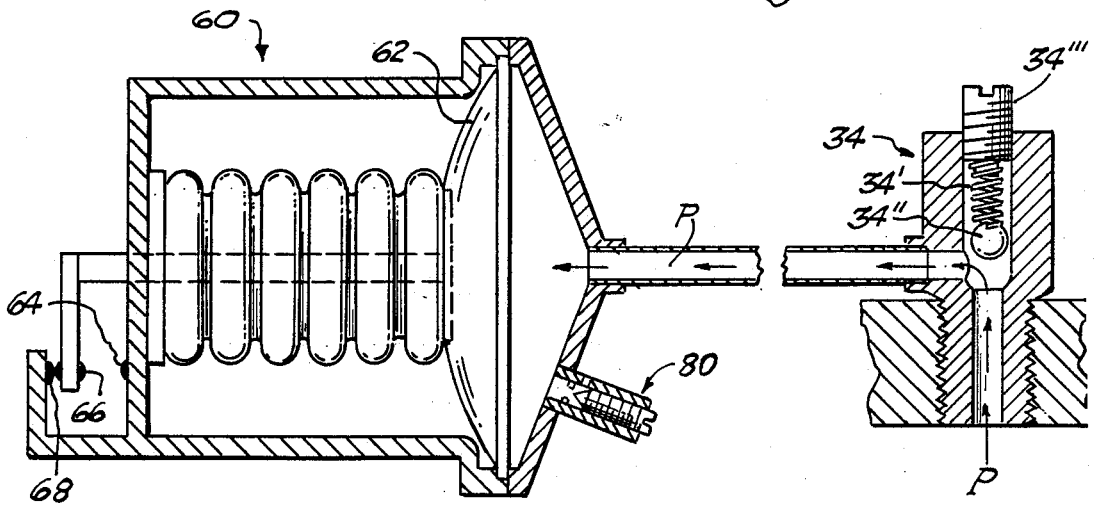
FIG. 2B shows the cross-section of FIG. 2A wherein said pressure transducer means is biased into the open position by the presence of critical pressure P.
Figure 3:
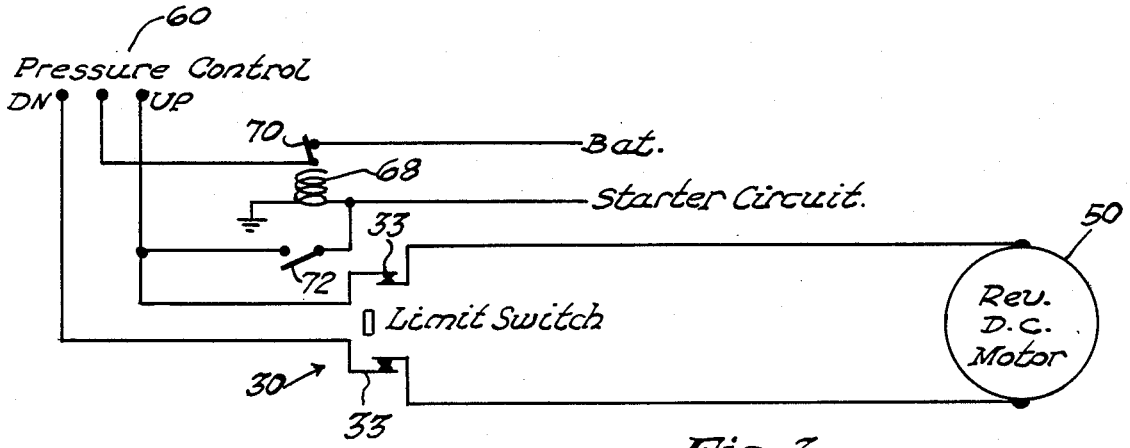
FIG. 3 is a schematic of the control system for moving the auxiliary piston.

In order that reversible motor 50 may be signaled for actuation of sub-piston 22 in the preferred embodiment, means for communicating the pressure within combustion chamber 18 and means for switching on reversible motor 50 are provided in the form of normally closed valve means 34, as best seen in FIGS. 2A and 2B, connected to a diagram switch 60, best seen in FIG. 4. Upon the presence of sufficient atmospheric pressure P in combustion chamber 18, spring 34' is forced open by virtue of its interconnection with ball 34''. Valve means 34 may be adjusted by means such as set screw 34''' such that ball 34'' will be forced to move against said spring 34' only upon the exertion of predetermined amount of pressure P or greater in combustion chamber 18. Once ball 34'' is moved, air pressure P forces against the bellows 62 of diagram switch 60, thereby mechanically closing contact points 66 and 68, as shown in FIGS. 3 and 4. Once points 66 and 68 are connected, the reversible DC motor is energized as a result of the completion of the circuit of FIG. 4. Points 64 and 66 are normally closed when ball 34'' is in its normally closed or sealing position. When points 64 and 66 are closed, or in contact, reversible DC motor is activated causing sub piston 22 to move downwardly. This increasingly elevates the pressure within combustion chamber 18. When that pressure reaches the critical predetermined pressure P, ball 34'' opens, opening points 64 and 66 and closing points 66 and 68. Opening of points 64 and 66 deactivates motor 50 and closure of points 66 and 68 re-energizes motor 50, but in the opposite direction so that sub-piston 22 moves upwardly, increasing the volume in combustion chamber 18 and thereby decreasing the pressure therein. When that pressure drops below P, valve 34 closes, thereby causing bellows 62 to relax from the position shown in FIG. 2B to that of FIG. 2A' which further causes arm 62' to open points 66 and 68 and to close points 64 and 66. This opening of points 66 and 68 de-energizes motor 50, thereby stopping the upward movement of sub-piston 22. This closing of points 64 and 66 re-energizes motor 50, causing sub-piston to move downwardly until pressure P is again reached, at which time the cycle will be repeated.

FIG. 3 shows the preferred embodiment of the electronic control means leading to activation of reversible motor 50 upon the opening or closing of valve means 34 and/or of points 30. Said circuit works as follows:

To start the integral combustion engine, a common starter circuit as shown in FIG. 3 is employed wherein solenoid 68 is energized, thereby opening points A-B of normally closed switch 70. Switch 72 is normally opened but is closed upon energization of the starter circuit, closing the reversible DC motor circuit to move the piston into the full up position. Deenergization of the starter circuit opens normally open switch 72 to resume its open state, and also causes normally closed switch 70 to close. This condition, immediately after start-up of the internal combustion engine, brings about the necessity to lower piston 22 due to the low operating RPM and hence relatively 1o internal combustion chamber pressure chamber at idle. That is, ball 34'' is in its normally closed position and hence contact points 64 and 66 are in contact, leading motor 50 to cause sub-piston 22 to move downwardly.

It should be noted that contacts 31 and 33 are provided to be closed when piston 22 is in the mid-range of its travel stroke.

Once reversible motor 50 is energized, thereby causing shaft 28 and piston 22 to move either up or down, means for disengaging or deactivating said motor 50 is provided, preferably in the form of an electrical limit switch 30 having contacts 31 and 33. As seen in FIG. 1A, when the sub-piston 22 is in the full raised position, contacts 31 are forced open by shaft end 28', thereby de-activating motor 50 so no damage is done to the apparatus where motor 50 remains energized yet piston 22 is prevented from moving. As shown in FIG. 1B, when the sub-piston 22 is in the fully lowered position, contacts 33 are forced open. Opening of either said contacts 31 or 33 causes said reversible motor 50 to be deactivated. Appropriate circuit means, shown in FIG. 3, are employed such that upon deactivation of motor 50 by virtue of the opening of contacts 31 or 33, the next successive start-up of said reversible motor means 50, which can only be brought about by opening or closing of valve means 34, caused by a change in pressure within combustion chamber 18, will cause said sub-piston 22 to move in the direction opposite to its immediately preceding direction of movement.

What makes the instant invention especially novel and unique is the use of a free floating intake valve 40. The exhaust valve 40, is operated by either a convention rocker arm arrangement or overhead cam. Intake valve 40, however, is caused to open solely by the pressure within combustion chamber 18 (i.e. on the downstream side of valve 40) on the upstream side thereof. Intake valve spring 42 is selected to have a spring rate such that upon main piston 14 moving downwardly on the power and intake strokes, intake valve 40 will be sucked open by the vacuum created within chamber 18 caused by the increasing volume of chamber 18. Therefore it can be seen that intake valve 40 with its novel spring 42, free of direct contact from a rocker arm or cam lobe, allows the engine of the instant invention to operate over a wide variety of combustion chamber volumes while simultaneously maintaining the pressure therewithin to remain at or near constant.

The instant invention has been shown and described herein in what it is considered to be the most practical and preferred embodiment. It is recognized, however, that departures may be made therefrom within the scope of the invention and that obvious modifications will occur to a person skilled in the art.

What is claimed is:

1. In a conventional internal combustion engine having at least one combustion chamber, the combination of a first means for varying the volume of said combustion chamber, an intake valve operated solely by vacuum forces occurring within said combustion chamber, and a second means for varying the volume of said combustion chamber, said second means for varying the volume of said combustion chamber being selectively movable in response to pressure conditions within said combustion chamber.

2. The combination of claim 1, wherein:

said first means for varying the volume is a conventional piston of said internal combustion engine reciprocally movable within said combustion chamber.

3. The combination of claim wherein said second means for varying the volume of said combustion chamber is comprised of:

a sub-piston means reciprocally movable in association with said combustion chamber toward and away from said first means for varying the pressure;

means for selectively reciprocally moving said sub-piston between a first, lowered, position and a second, raised, position in response to changes in combustion pressure within said combustion chamber;

valve means for communicating the combustion chamber with said means for moving said sub-piston.

4. The combination of claim 3, wherein said valve means is comprised of a normally closed valve openable upon the exertion thereon by a predetermined amount of combustion chamber pressure, said valve means being operably connected to said means for moving said sub-piston such that the opening or closing of said valve means activates said means for moving said sub-piston causing said sub-piston to move up or down, respectively.

5. The combination of claim 4, wherein:

said means for moving said sub-piston is comprised of a reversible DC motor actuatable upon opening or closing of said valve means;

said motor having an output shaft operably associated with said sub-piston for movement thereof;

said sub-piston having operably associated therewith means for disengaging said motor wherein when said sub-piston reaches either the raised or lowered position, said means for disengaging said motor deactivates said motor, and any next activation thereof being in the opposite direction with respect to the raised or lowered position of said sub-piston, said next actuation being caused by the opening or closing, respectively, of said valve means.

* * * * *

UNITED STATES PATENT AND TRADEMARK OFFICE

CERTIFICATE OF CORRECTION

PATENT NO. : 4,890,585

DATED : January 2, 1990

INVENTOR(S) : William Hathorn

It is certified that error appears in the above-identified patent and that said Letters Patent is hereby corrected as shown below:

On the title page:

[73] Assignee: None

The printed patent incorrectly indicates assignment to:

General Electric Company.

Signed and Sealed this

Twenty-ninth Day of January, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,890,585

DATED : January 2, 1990

INVENTOR(S) : William Hathorn

It is certified that error appears in the above-identified patent and that said Letters Patent is hereby corrected as shown below:

On the cover page, after "Attorney, Agent, or Firm", delete "Jerome C. Squillaro; Nathan D. Herkamp" and replace therefore -- Malin, Haley, & McHale--.

Signed and Sealed this

Second Day of April, 1991

*Attest:*

HARRY F. MANBECK, JR.

*Attesting Officer*

*Commissioner of Patents and Trademarks*